US005878611A

United States Patent [19]

Lerchner et al.

[11] Patent Number: 5,878,611

[45] Date of Patent: Mar. 9, 1999

[54] FLAT KEY

[75] Inventors: Leonhard Lerchner, Salzburg, Austria; Hermann Hainzlmaier, Geisenfeld, Germany

[73] Assignee: Keso Salzburg-GmbH, Salzburg, Austria

[21] Appl. No.: 941,440

[22] Filed: Sep. 30, 1997

[30] Foreign Application Priority Data

Oct. 24, 1996 [DE] Germany ..... 196 44 308.3

[51] Int. Cl.[6] ..... E05B 47/00; E05B 19/04

[52] U.S. Cl. ..... 70/276; 70/408; 70/278; 70/395; 70/413

[58] Field of Search ..... 70/408, 278, 395, 70/413, 276

[56] References Cited

U.S. PATENT DOCUMENTS

| | | | |
|---|---|---|---|
| 4,663,952 | 5/1987 | Gelhard | 70/278 |
| 4,918,955 | 4/1990 | Kimura et al. | 70/277 |
| 4,922,736 | 5/1990 | Tanaka et al. | 70/277 |
| 4,924,686 | 5/1990 | Vonlanthen | 70/277 |
| 4,936,896 | 6/1990 | Takatsuka | 70/432 |
| 4,998,952 | 3/1991 | Hyatt, Jr. et al. | 70/395 |
| 5,117,097 | 5/1992 | Kimura et al. | 235/439 |
| 5,195,341 | 3/1993 | Nieuwkoop | 70/278 |
| 5,311,757 | 5/1994 | Spahn | 70/408 |
| 5,433,096 | 7/1995 | Janssen et al. | 70/278 |
| 5,469,727 | 11/1995 | Spahn et al. | 70/278 |
| 5,548,984 | 8/1996 | Miyatsu | 70/276 |
| 5,632,168 | 5/1997 | Yano | 70/278 |
| 5,735,152 | 4/1998 | Dietz et al. | 70/278 |

FOREIGN PATENT DOCUMENTS

| | | |
|---|---|---|
| 0 187 363 | 7/1986 | European Pat. Off. . |
| 0 559 158A1 | 9/1993 | European Pat. Off. . |
| 32 44 566A1 | 6/1984 | Germany . |
| G89 11 016.1 | 12/1989 | Germany . |
| 195 17 728 | 11/1996 | Germany . |
| 2 273 128 | 6/1994 | United Kingdom . |

OTHER PUBLICATIONS

U.S. application No. 08/646472, filed May, 1996 (19 pages).

*Primary Examiner*—Steven Meyers
*Assistant Examiner*—Clifford B Vaterlaus
*Attorney, Agent, or Firm*—Flynn, Thiel, Boutell & Tanis, P.C.

[57] ABSTRACT

A flat metal key has a groove-shaped recess in the narrow side of the bow for receiving a transponder as a code transmitter, a ferrite coil and a line connecting the ferrite coil with the code transmitter.

14 Claims, 1 Drawing Sheet

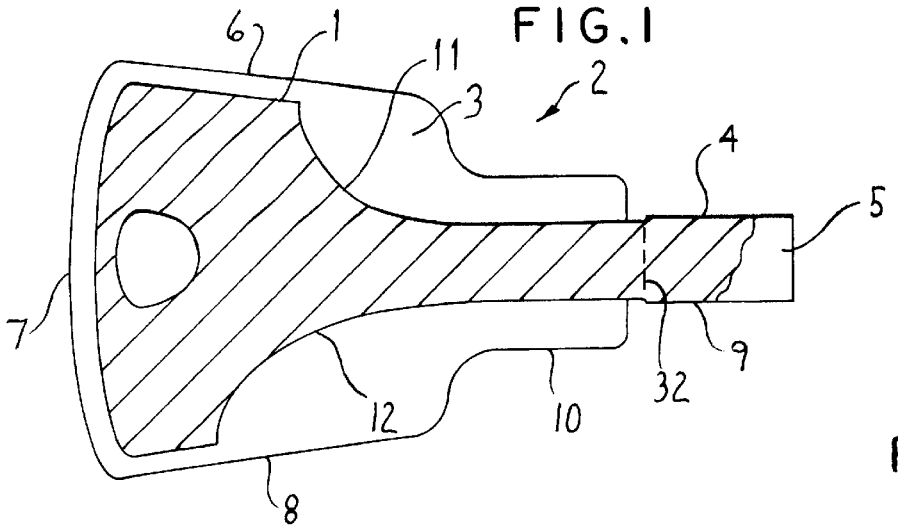
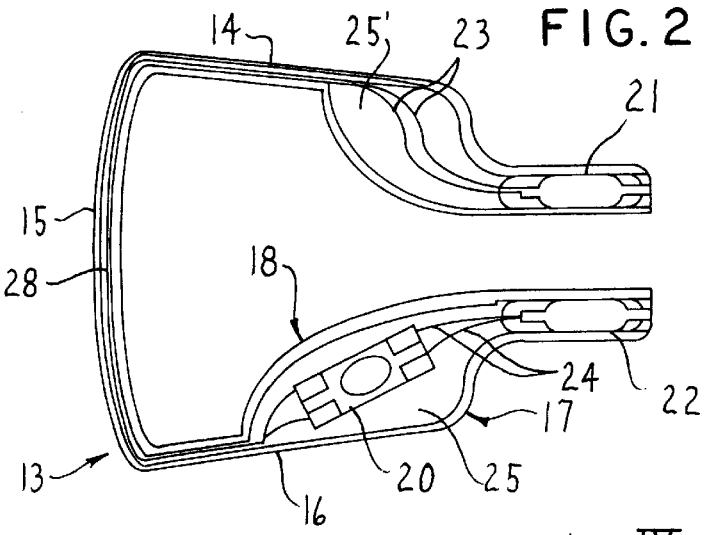
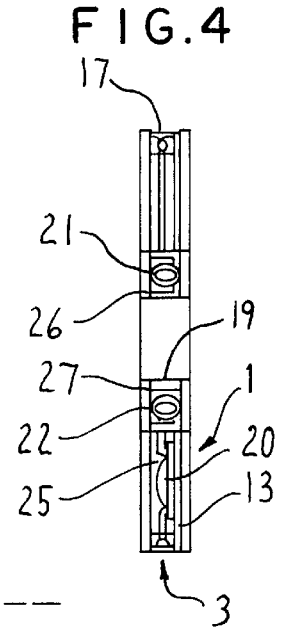
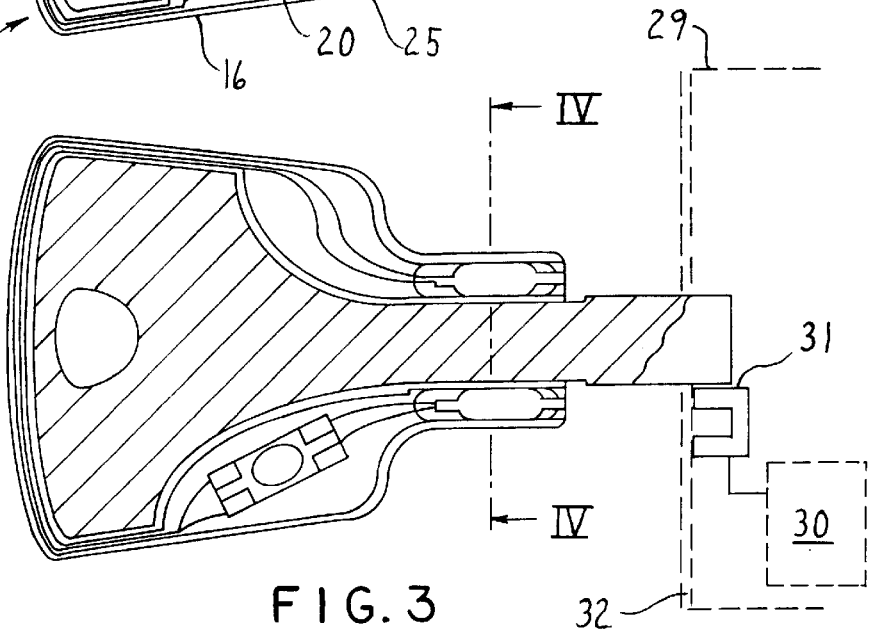
FIG. 3

FLAT KEY

FIELD OF THE INVENTION

This invention refers to a flat metal key having a transponder as a code transmitter.

BACKGROUND OF THE INVENTION

A flat key with a transmitter is known for example from GB 2,273,128 A. The code transmitter is provided together with the ferrite antenna in a recess in the tip of the shaft. Thus, a considerable part of the shaft cannot be provided with locking depressions for the tumblers of the lock.

Further it is known to dispose the code transmitter and the ferrite antenna in a plastic sheath on the broad sides of the bow of a flat key. However this forms a voluminous key which is bulky in a bunch of keys.

German patent application 195 17 728.2/U.S. patent application Ser. No. 08/646,472 discloses a reversible flat key wherein two ferrite antennas are disposed on the two narrow sides of the bow on the side of the bow facing the shaft.

SUMMARY OF THE INVENTION

The object of the invention is to provide a flat key having a transponder as a code transmitter which corresponds to a conventional flat key both in its outside dimensions and in strength.

This is obtained according to the invention with a flat key having in the narrow side of the bow a groove-shaped recess for receiving the code transmitter, the ferrite coil and the line connecting the ferrite coil with the code transmitter, the ferrite coil being disposed on the side of the bow facing the shaft.

The inventive flat key has the same dimensions, in particular the same thickness, as a conventional flat key (without a code transmitter) for cylinder locks. It is thus for example no bulkier in a bunch of keys than a normal flat key. Due to the same outer form, the same appearance and the same dimensions as a normal flat key, one also does not notice that the inventive flat key is a key with a code transmitter.

For operating a cylinder lock, one handles the inventive key in the same way as a conventional flat key without a code transmitter.

In the groove-shaped recess in the narrow side of the bow one according to the invention preferably inserts a carrier having the code transmitter, the ferrite coil and the line connecting the code transmitter with the ferrite coil. The inserted carrier is glued into the recess with an adhesive or cast therein with a compound.

The code transmitter or data carrier of the inventive key preferably has a write-read memory. The code transmitter can be disposed on a circuit board connected with the ferrite antenna.

The inventive key is preferably intended for a cylinder lock whose cylinder core mounted in the cylinder housing is provided with a key channel having mechanical tumblers for blocking or releasing the cylinder. The lock also has the cylinder housing for shifting a blocking element blocking or releasing the cylinder core, and a power supply unit. A code evaluator formed by a transponder reading device is preferably provided in the cylinder housing for controlling the actuator, and the blocking element engages at least one recess disposed on the circumference of the cylinder core at a distance from the key channel in the axial area of the cylinder core, which is provided with the mechanical tumblers. Such a cylinder lock is found in German patent application 195 17 728.2/U.S. patent application Ser. No. 08/646,472.

The transponder reading device has a ferrite antenna whose free end extends as far as the face of the cylinder housing. The ferrite antenna is preferably formed as a pot-core coil with its opening directed outward, the pot being covered with a metal plate on the face of the cylinder lock for safety from manipulation.

The inventive key is preferably formed as a reversible key. For this purpose the groove-shaped recess extends from a narrow side of the shaft around the total narrow side of the bow to the other narrow side of the shaft, whereby one ferrite coil connected with the code transmitter via a line is provided on each narrow side of the bow in the groove-shaped recess. Thus, when the key is inserted into the cylinder lock one of the two ferrite coils of the key is always opposite the ferrite coil of the transponder reading device of the cylinder lock.

However an inventive flat key not formed as a reversible key can also be provided with two ferrite coils to increase the power consumption.

Although the inventive flat key is primarily intended for a cylinder lock with an actuator as described above, it can also be used as a data carrier independently of a cylinder lock, i.e. for any other devices having a transponder reading and/or writing device, for example access control devices with a transponder reading device or as a data carrier for check devices for entitlement to services.

Since it is located in the groove-shaped recess in the narrow side of the bow, the data carrier or code transmitter is enclosed by metal on three sides. The code transmitter is thus protected mechanically. Also, the inventive key thus has no injection molded plastic parts which can break off. It thus has high mechanical strength and, since it is made completely of metal, apart from the groove in the narrow side, it neither wears out nor is scratched.

BRIEF DESCRIPTION OF THE DRAWINGS

In the following description, an embodiment of the inventive flat key will be explained more closely in the drawing, in which:

FIG. 1 shows a longitudinal section through a reversible flat metal key with a groove-shaped recess in the narrow side of the bow, the shaft being rendered only partly;

FIG. 2 shows a top view of a module insertable into the groove-shaped recess of the key of FIG. 1;

FIG. 3 shows a longitudinal section through the key after insertion of the module of FIG. 2 into the groove-shaped recess; and FIG. 4 shows a cross section through the key along line IV—IV in FIG. 3.

DETAILED DESCRIPTION

According to FIG. 1 groove-shaped recess 3 is milled into bow 1 of conventional reversible flat metal key 2. The recess 3 extends from one, upper narrow side 4 of shaft 5 around the total narrow side, i.e. upper narrow side 6, an end side 7 facing away from shaft 5 and lower narrow side 8 of bow 1 to the other, i.e. lower, narrow side 9 of shaft 5.

Key 2 is intended for a cylinder lock with an armored housing. On the side of bow 1 facing shaft 5 there is therefore widening 10 which, when key 2 is inserted into the cylinder lock, is disposed in a slot in a disk mounted rotatably in the armored housing.

Groove-shaped recess 3 extends through the area of widening 10. Through suitable contour milling it further has concave indentations 11 and 12 on upper and lower narrow sides 6 and 8 of bow 1, indentations 11, 12 opening toward shaft 5. One, upper indentation 11 in FIG. 1 can also be dispensed with.

The module shown in FIG. 2 is inserted into groove-shaped recess 3 of bow 1 of FIG. 1, said module having bow-shaped carrier 13 consisting in accordance with groove-shaped recess 3 of upper portion 14, middle portion 15 and lower portion 16. Outside edge 17 of carrier 13 corresponds to the outside contour of bow 1, its inside edge 18 to the contour of bottom 19 (FIG. 4) of groove 3 in the narrow side of bow 1. The module with carrier 13 is equipped with chip or data carrier 20 forming the code transmitter or transponder of key 2, and further with the two ferrite coils 21, 22 and lines 23, 24 connecting ferrite coils 21, 22 with code transmitter 20.

Code transmitter 20 is provided in pocket 25 between outside edge 17 and inside edge 18 of carrier 13, while ferrite coils 21, 22 are disposed in longitudinal recesses 26, 27 at the two ends of bow-shaped carrier 13.

One line 24 extends from chip 20 in pocket 25 directly to ferrite coil 22, while other line 23 extends to ferrite coil 21 on the other side of bow 1 in groove 28 in upper portion 14, middle portion 15 and lower portion 16 of carrier 13. Carrier 13 is formed symmetrically to the longitudinal key axis according to FIG. 2. Upper pocket 25' can also be dispensed with however.

Carrier 13 is formed in one piece and preferably made of plastic. Code transmitter 20 can be disposed on a circuit board which is disposed in pocket 25, groove 28 and pocket 25' and connected to the two ferrite coils 21, 22.

The module, i.e. carrier 13 equipped with code transmitter 20, lines 23, 24 or the circuit board and ferrite coils 21, 22, is inserted into groove-shaped recess 3 in the narrow side of bow 1.

Since outside edge 17 of carrier 13 according to FIG. 4 has the same width as the width of groove-shaped recess 3, it seals carrier 13 from the outside.

Key 2 can be formed as a reversible flat key for a cylinder lock, which is designated as 29 in FIG. 3. The cylinder lock can be formed in accordance with German patent application 195 17 728.2/U.S. patent application Ser. No. 08/646,472 . That is, a cylinder core is mounted rotatably in a cylinder housing and its key channel is provided with mechanical tumblers for blocking or releasing the cylinder core.

In the cylinder housing there is an actuator for shifting a blocking element blocking or releasing the cylinder core. The cylinder housing further contains an electronic code evaluator for controlling the actuator. The electronic code evaluator is formed by transponder reading device 30 which has ferrite antenna 31.

As indicated in FIG. 3, ferrite antenna 31 is formed as a pot antenna which is covered with plate 32 on the face of the cylinder housing.

With inventive key 2, the whole of shaft 5 can be provided with locking depressions for the tumblers of cylinder lock 29.

Since it only has groove-shaped recess 3 in bow 1, inventive key 2 can essentially take up the same torsional forces as a conventional flat key (without a code transmitter).

It is usual with flat keys that at a given high torsional force of generally 10 Nm shaft 5 breaks at bow 1, i.e. at 32, in order to prevent forcible opening or destruction of cylinder lock 29. With inventive key 2 such a predetermined high torsional force can readily be adjusted.

In addition the forces extend on both sides of the key axis upon rotation of key 2. Since plastic carrier 13 can take up relatively large torsion undamaged, key 2 remains fully operable even if bow 1 is bent relative to shaft 5 by rotation.

What is claimed is:

1. A flat key assembly, the key having a bow with opposed narrow sides, an end side extending between the narrow sides; wherein, a recess is formed in the bow, an elongated shaft that extends from a portion of the bow opposite the end side, said shaft having opposed narrow sides; a code transmitter disposed in the recess; at least one ferrite coil disposed in the recess; and a conductive line in the recess for connecting the code transmitter with the ferrite coil, the improvement comprising:

the recess is formed to be groove-shaped and extends from a first narrow side of the shaft to a first narrow side of the bow, to the end side of bow, to a second narrow side of the bow and to a second narrow side of the shaft;

two ferrite coils are disposed in the recess wherein a first one of the ferrite coils is located in a section of the recess located adjacent the first narrow side of the shaft and a second one of the ferrite coils is located in a section of the recess adjacent the second narrow side of the shaft and each ferrite coil is connected to the code transmitter by a conductive line; and the key, including the bow and the shaft, is formed from metal so that the recess is defined by metal so that the ferrite coils, the conductive lines and the code transmitter are enclosed on three sides by metal.

2. The flat key of claim 1, wherein the groove-shaped recess has a indentation for receiving the code transmitter.

3. The flat key of claim 2, wherein the indentation is provided on one of the narrow sides of the bow.

4. The flat key of claim 1, wherein a carrier insertable into the groove-shaped recess is provided for receiving the code transmitter, the ferrite coils and the conductive lines.

5. The flat key of claim 4, wherein the carrier has a width corresponding to a width of the groove-shaped recess.

6. The flat key of claim 5, wherein the carrier has an outside edge with a contour that corresponds to an outside contour of the bow in the area of the groove-shaped recess.

7. The flat key of claim 4, wherein a contour of an inside edge of the carrier corresponds to a contour of the bottom of the groove-shaped recess.

8. The flat key of claim 4, wherein the carrier is formed with a pocket for receiving the code transmitter and two gaps, each gap receiving a separate one of the ferrite coils.

9. The flat key of claim 4, wherein the carrier has an inner edge with a contour that corresponds to an inner contour of the groove-shaped recess.

10. The flat key of claim 1, wherein the code transmitter is disposed on a circuit board connected to the ferrite coils.

11. A key assembly including:

a key body, said key body shaped to have: a wide bow having opposed narrow sides, and an end side extending between the narrow sides; a narrow shaft that extends away from a portion of the bow opposite the end side said shaft having opposed narrow sides; and a groove-shaped recess that extends from a first narrow side of the shaft, to a first narrow side of the bow, to the end side of the bow, to a second narrow side of the bow and to a second narrow side of the shaft wherein, the key body is made of metal so that said recess is defined by metal;

a code transmitter disposed in said recess;

two ferrite coils, one said ferrite coil being located in a section of said recess located adjacent said first narrow side of said shaft and a second said ferrite coil being located in a section of said recess located adjacent said second narrow side of said shaft; and conductive lines disposed in said recess for connecting said ferrite coils to said code transmitter, a set of said conductive lines being located in a section of said recess located adjacent said end side of said bow.

12. The key of claim 11, wherein a non-conductive carrier is seated in said recess and said code transmitter, said ferrite coils and said conductive lines are seated in said carrier.

13. The key of claim 11, wherein said code transmitter is disposed on a circuit board and said lines extend from said circuit board to said ferrite coils.

14. The key of claim 11, wherein said key body is formed to be reversible.

* * * * *